United States Patent [19]

Hofmann

[11] Patent Number: 4,761,848

[45] Date of Patent: Aug. 9, 1988

[54] SUCTION-OPERATED AUTOMATIC SWIMMING POOL CLEANER

[76] Inventor: Helmut J. Hofmann, 1800 S.W. 7th Ave., Pompano Beach, Fla. 33060

[21] Appl. No.: 74,574

[22] Filed: Jul. 17, 1987

Related U.S. Application Data

[63] Continuation of Ser. No. 915,058, Oct. 3, 1986.

[51] Int. Cl.[4] ..... E04H 3/20

[52] U.S. Cl. ..... 15/1.7; 210/169

[58] Field of Search ..... 15/1.7, 404, 419, 421; 210/169; 251/5, 155, 243; 37/58; 137/624.14, 853; 239/101

[56] References Cited

U.S. PATENT DOCUMENTS

| | | | |
|---|---|---|---|
| 2,250,021 | 7/1941 | Hofer | 37/58 |
| 2,978,733 | 4/1961 | Wahlborg | 15/421 |
| 3,263,615 | 8/1966 | Hofer | 37/58 |
| 3,803,658 | 4/1974 | Raubenheimer | 15/1.7 |
| 4,023,227 | 5/1977 | Chauvier | 15/1.7 |
| 4,642,833 | 2/1987 | Stoltz et al. | 15/1.7 |

*Primary Examiner*—Harvey C. Hornsby
*Assistant Examiner*—C. Reinckens
*Attorney, Agent, or Firm*—Arnold, White & Durkee

[57] ABSTRACT

A suction-operated swimming pool cleaner includes a valve in the outlet for venting applied suction upon contact of the pool cleaner with an obstruction to movement. Venting of applied suction reduces suction adherence of the head to the pool surface and permits reorientation of the cleaner to be free of the obstruction.

6 Claims, 2 Drawing Sheets

POOL SURFACE
46
120
44
43
40
41
52
50
60
42
51
20
30
35
32
130
122
132
121
3
110
100
90
92

SUCTION-OPERATED AUTOMATIC SWIMMING POOL CLEANER

This is a continuation of application Ser. No. 915,058, filed Oct. 3, 1986.

BACKGROUND OF THE INVENTION

The present invention relates to apparatus for cleaning the submerged surface of a swimming pool; and more particularly, it relates to an automatic pool cleaner of the water interruption type.

In a water interruption pool cleaner, water flow through the head of the device is created by suction applied to an outlet connected by a flexible hose to the swimming pool water circulation system. An automatic valve member in the head interrupts the water flow and simultaneously reduces suction adherence to the submerged surface. The sudden interruption of water flow produces a change in momentum of the mass of water in the device and, through the fundamental action/reaction principle, creates a motive force on the device. Illustrative of water interruption type pool cleaners are those described in the prior art patents of: U.S. Pat. No. 3,803,658 (Raubenheimer); U.S. Pat. No. 4,023,227 (Chauvier); U.S. Pat. No. 4,208,752 (Hofmann); and of application Ser. No. 749,793 filed June 28, 1985 and titled "Valve Assembly." Further illustrative of wate interruption type pool cleaners are the BARACUDA ALPHA pool cleaner and the KREEPY KRAULY pool cleaner.

Water interruption pool cleaners include a head having an open mouth inlet to admit water. Water is sucked through the head by suction applied to an outlet provided for connection to a flexible hose. The water flow passage between the inlet and the outlet is inclined at an angle. The head, however, is configured to have the open mouth lie in a substantially horizontal plane to facilitate cleaning planar, submerged surfaces. Accordingly, the water flow path through the head from the open mouth to the outlet is disposed at an angle with respect to the planar surface to the cleaned.

The motive force imparted to the head of the device upon an interruption of water flow is along a line of action following the direction of water flow. The net motive force includes a component parallel to the plane of the submerged surface and in the direction of the hose connection. Thus, forward movement in normal operation is in the direction of the outlet and connected flexible hose. This movement presents a problem when the device encounters an obstruction such as, for example, steps in the pool, a pool ladder on a wall, or a bench formed in a pool wall, in that the device becomes lodged between such obstructions and the pool wall. Further, in pools having substantially right angle corners, the device can become lodged in a corner and cannot extricate itself.

Heretofore, the problem of a water interruption pool cleaner becoming lodged and unmovable by reason of an obstruction in the pool has been addressed by various bumper guard structures affixed to the device. Illustrative of such bumper guards is that shown in U.S. Pat. No. 4,463,468. While helpful, bumper guards are not wholly satisfactory. The bumper guards are themselves prone to lodging and entangling with obstructions. Also, deflection of the device away from obstructions can lead to certain areas of the pool remaining uncleaned. Accordingly, there continues a need for a solution to the problem.

SUMMARY OF THE INVENTION

A suction-operated pool cleaner having a head with an outlet for connection with a flexible hose and an automatic valve within the head for creating motive force includes a valve in the outlet for venting applied suction to ambient in response to contact of the pool cleaner with obstructions to movement. The diversion of applied suction from the head reduces suction adherence of the head to the submerged surface and permits reorientation of the cleaner so as to be freed from the obstruction.

The valve may comprise a port opening in the outlet and a valve member actuated upon contact of the pool cleaner with an obstruction. The port is closed during normal operation of the pool cleaner. Upon contact with an obstruction, the valve member opens the port and vents the applied suction.

BRIEF DESCRIPTION OF THE DRAWINGS

A written description setting forth the best mode presently known for carrying out the present invention, and of the manner of implementing and using it, is provided by the following detailed description of preferred embodiments which are illustrated in the attached drawings wherein.

DETAILED DESCRIPTION

Figures 1, 2, 3:
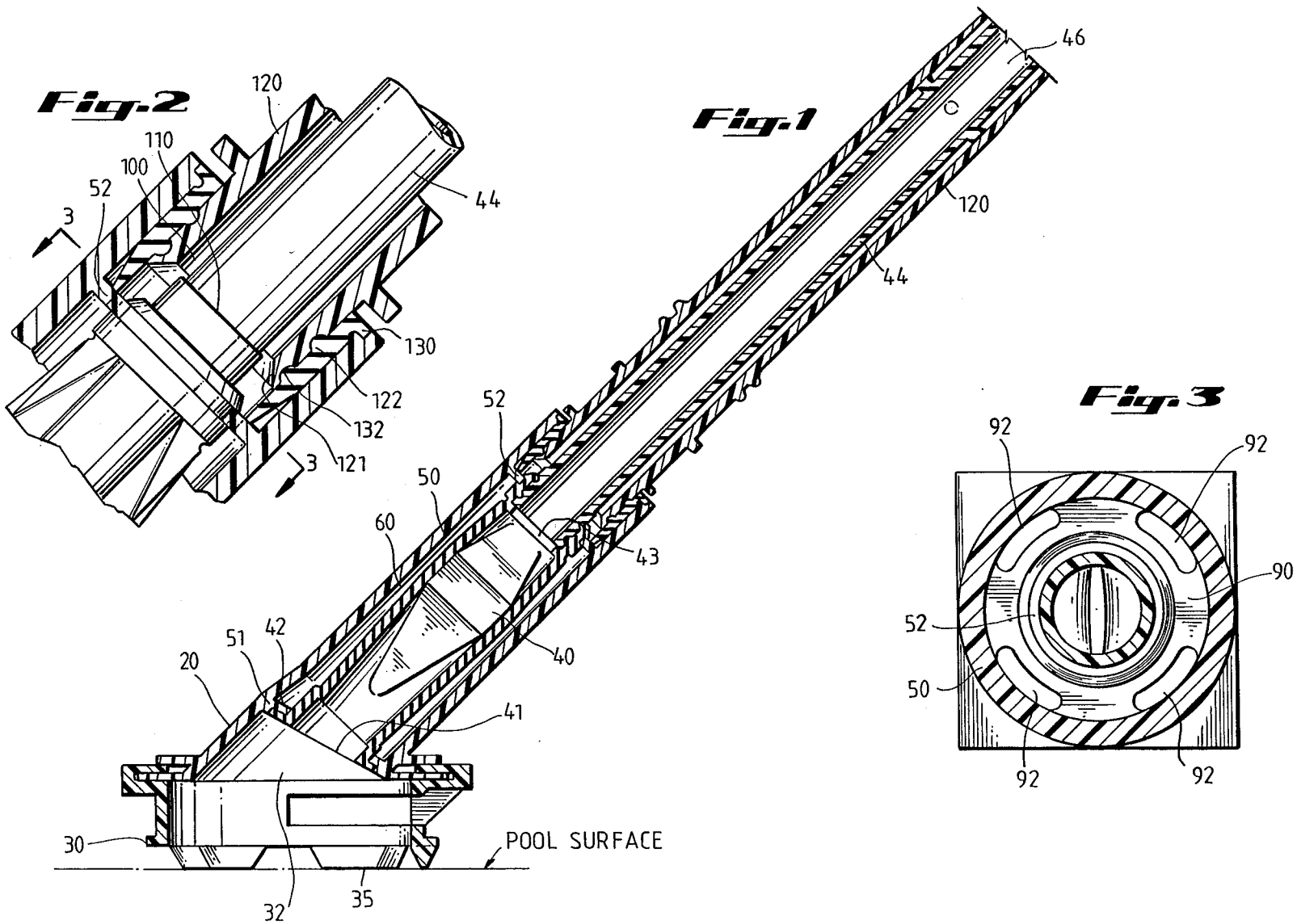
FIG. 1 is a cross section of a water interruption type pool cleaner that utilizes a flexible tubular member as the valve for effecting the water interruption function.
FIG. 2 is an enlarged view of a portion of the cleaner of FIG. 1.
FIG. 3 is a section taken along lines 3—3 of FIG. 1.

Referring to FIGS. 1, 2, and 3, the inner body portion of an automatic pool cleaner of the water interruption type is shown having an operating head 20 and a foot 30 for the cleaner to contact the surface to be cleaned. The head 20 includes an inlet mouth 32 to a flexible tubular valve member or diaphragm 40. The inlet end 41 of valve 40 is enlarged to define a flange 42 which engages and seals against a flange 51 on the body 50. The outlet 43 of valve 40 engages an internal collar 52 formed by plate 90. Engagement is by a circumferential recess in the upper end of valve 40. The valve is insertable into body 50 through mouth 32. The outlet end 43 of valve 40 communicates with an elongated rigid tubular section 44 and outlet 46. The flexible valve member 40 is housed within body 50 to define a chamber 60. The upper or downstream end of chamber 60 is defined by a plate 90. Plate 90 as shown in FIG. 3 is substantially circular as is the cross section of body 50 above or downstream of plate 90. Below or upstream of plate 90, body 50 is square in shape. An annular space 100 exists between body 50 and a section 110 of the rigid tubular section 44. The end of section 110 is inserted into valve 40. A plurality of ports 92 in plate 90 provide for fluid communication between the interior of chamber 60 and the annulus 100.

The head has an outlet 33 for connection with a flexible hose. The outlet includes a substantially rigid conduit 120, which fits loosely around rigid section 44 of the tubular passageway above the valve 40. Lower end 121 of conduit 120 defines the lower portion of annular space 100 permitting suction communication from space 100 through slots 92 to chamber 60. End 121 has one or more peripheral grooves 122 on its outer surface.

A bushing 130 is press fit into the round upper end portion of body 50. Bushing 130 has one or more peripheral ridges 132 which snap or otherwise fit loosely within the grooves 122 to lock conduit 120 to the bushing. The conduit 120 is joined to body 50 by simply forcing bushing 130 into the circular upper end portion of the body.

In operation, the chamber 60 has a suction connection to the outlet 46. The chamber becomes filled with water upon immersion of the device through the loose connection at conduit 120 and bushing 130 and through annular space 100. An inlet to chamber 60 may be provided if desired.

It should be clearly understood that it is not essential for the diaphragm valve member to completely cut off flow. It is satisfactory if there is produced an interruption of the water stream through the tubular passageway sufficient to induce movement in the device.

Expansion of the diaphragm valve member and release for it to reassume its relaxed condition is by the creation of a pressure differential across the valve member walls, i.e., a pressure difference between the chamber 60 and the interior of the valve member. This is created by the suction applied to the tube 120. The valve member is autonomously opened and closed. Applied suction initially causes valve 40 to open; but with water flow established, the pressure within valve 40 drops below that of chamber 60. The valve thus closes. The cycle autonomously repeats.

As indicated in FIG. 1, the head and outlet conduit as disposed at an angle with respect to the plane of the head portion or foot 35 which rests on the pool surface. Movement is to the direction in which the pool cleaner is inclined; i.e., toward the flexible hose.

When suction is applied to outlet 33, suction adherence of the head to the submerged pool surface is created, and water flow between the inlet 32 and the outlet is induced. The valve 40 also begins its autonomous action. Contraction of valve 40 interrupts water flow and imparts motive force to the head. Simultaneously, suction adherence of the head to the pool surface is reduced. As operation continues, the pool cleaner moves across the pool surface vacuuming debris from the pool and delivering it into the pool's filter-circulation system.

Figure 4:
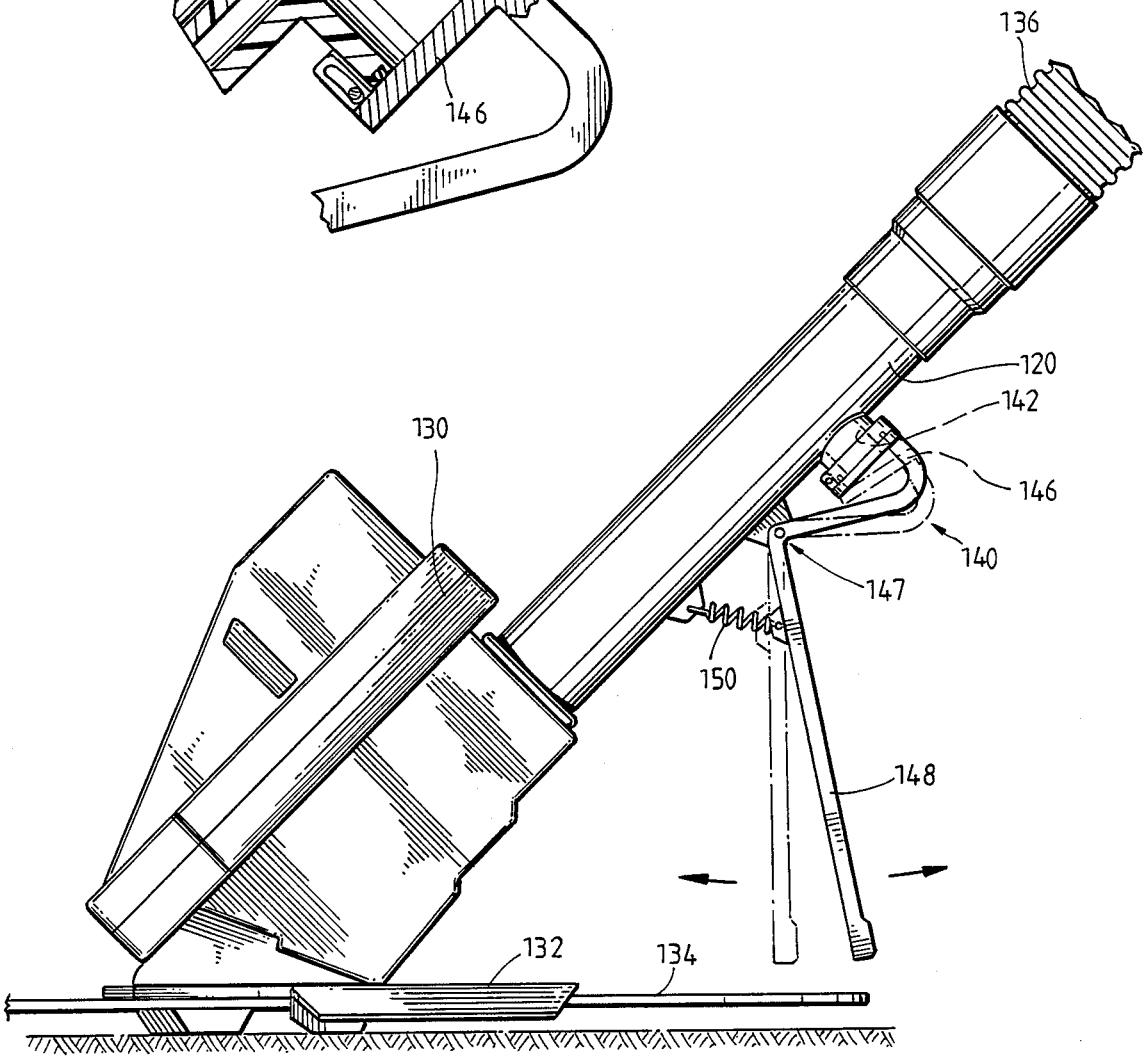
FIG. 4 is an illustration of a water interruption pool cleaner in accordance with the present invention having a valve in the outlet for venting applied suction to ambient upon contact with an obstruction in the pool.

Referring now to FIG. 4, the pool cleaner of FIGS. 1–3 is shown with an outer housing 130 shrouding the inner body. The pool cleaner also carries a flange 132 and a peripheral disc 134. In FIG. 4, the attachment of outlet conduit 120 to a flexible hose 136 is shown.

Figure 5:
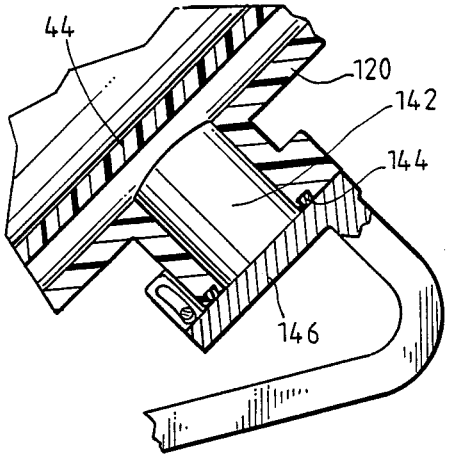
FIG. 5 is a detailed illustration of the outlet valve of the pool cleaner shown in FIG. 4.

Further shown in FIG. 4 and FIG. 5 is a valve mechanism 140 located in the outlet 33 upstream of diaphragm valve 40. The valve mechanism includes a port opening 142 in the conduit 120. An O-ring seal 144 is provided at the port opening to facilitate sealing of the port by valve member 146 during normal operation of the pool cleaner. Valve member 146 is actuated by a lever 148 which is pivotally affixed to conduit 120. A clevis and pin arrangement 147 is used and the lever arm is biased with a compressed spring 150 to cause valve member 146 to normally close port 142.

The lever 148 is disposed in a plane substantially parallel to the vertical plane containing the centerline axis of the outlet conduit; and preferably, the lever lies in the same plane. Lever 148 is configured to extend away from the outer housing 130. This positions the lever for contact with obstructions in the pool (i.e., steps, ladders, benches) which might entangle, block or otherwise impede or entrap the pool cleaner and prevent its movement.

In normal operation, valve member 146 closes port 142. When the pool cleaner moves against an obstruction, lever 148 is engaged and causes valve member 146 to be actuated so as to open port 142. Opening port 142 vents the suction applied to outlet conduit 120 and causes suction adherence of the head to the pool surface to be substantially reduced for release from the pool surface. The venting of port 142 and the diversion of applied suction from valve 40 and mouth 32 need not be a complete removal of applied suction therefrom. The applied suction need only be reduced sufficiently to effect a sufficiently reduced adherence of the head to the pool surface to permit hose flexure to reorient the pool cleaner. In normal operation, the hose connected to the outlet is in compression. Upon venting the applied suction through port 142, the hose will relax and extend itself in a sudden movement or jerking motion. This flexing of the hose will typically change the orientation of the pool cleaner and allow it to move free of the obstruction.

The venting port and lever arrangement is applicable to the commercially available BARACUDA ALPHA pool cleaner. The outlet conduit 120 in that device has a diameter of about 1¼" I.D. The port opening 142 to be provided therein may be on the order of 1" I.D. Given the vacuum drawn by conventional swimming pool pumps, such port size appears to provide a sufficient reduction in applied suction upon venting of the port. The size of the port will, of course, vary depending upon the vacuum drawn by the pump used and the dimensions of the device, as would be apparent to a person of skill in the art.

The foregoing description has been directed to a particular preferred embodiment for purposes of explanation and illustration. It will be apparent, however, to those skilled in the art that the structure may be changed without departing from the essence of the invention. It is the intention that the following claims cover all equivalent modifications and variations which fall within the scope of the present invention.

What is claimed is:

1. A swimming pool cleaner operable from a suction source through a connecting flexible hose, comprising:

a head having a water flow path therethrough to an outlet connectable with a flexible hose, to permit suction to be applied producing a suction adherence of the head to a submerged pool surface;

an automatic valve within the head with means to create a motive force on the head during operation, so that the pool cleaner is moved across the submerged pool surface;

a valve in the outlet upstream of the automatic valve actuated in response to contact of the pool cleaner with an obstruction to movement, which obstruction is external to the water flow path through the head, for diverting applied suction from the head so that the suction adherence of the head with the submerged surface is reduced and to permit reorientation of the cleaner head.

2. A swimming pool cleaner operable from a suction through a flexible hose, comprising:

a head having a water flow path between an open mouth to be disposed proximate a submerged pool surface and an outlet for connection with a flexible hose, to permit suction adherence of the head to the said submerged pool surfaces by suction applied to the outlet;

an automatic submerged pool surface by suction applied to the outlet;

an automatic valve between the mouth and the outlet with means to impart motive force to the head during operation, so that the pool cleaner is moved across the submerged pool surface;

a normally-closed port in the outlet upstream of the automatic valve, for venting the applied suction to ambient to reduce suction adherence of the head when opened; and a mechanism carried by the head for opening the port upon contact with an obstruction to movement, which obstruction is external of the water flow path in the head.

3. A swimming pool cleaner operable from a suction source through a flexible hose, comprising:

a head having a water flow path including an open mouth in communication with an outlet for connection with a flexible hose, to permit suction adherence of the head to a submerged pool surface by suction applied to the outlet;

automatic valve means between the mouth and the outlet to impart a motive force to the head during operation, so that the pool cleaner is moved across the submerged pool surface;

a valving mechanism in the outlet upstream of the automatic valve means, for venting applied suction to ambient to reduce suction adherence of the head with the submerged surface, said valving mechanism including a port opening and a lever for controlling venting of the port, said lever venting the port upon contact with an obstruction to movement, which obstruction is external to the water flow path in the head.

4. A swimming pool cleaner operable from a suction source through a flexible hose, comprising:

a head having a water flow path including an open mouth in communication with an outlet including an elongated tubular member for connection with a flexible hose, to permit suction adherence of the head to a submerged pool surface by applying suction to the outlet;

automatic valve means between the mouth and the outlet, for creating motive force on the head during operation, so that the pool cleaner is moved across the submerged pool surface;

a port opening in the elongated tubular member, for venting applied suction to ambient to reduce suction adherence of the head;

a valve member for controlling venting of the port; and a lever coupled to the valve member for actuating same, said lever actuating the valve member so as to vent the port upon contact of the lever with an obstruction to movement of the pool cleaner, which obstruction is external to the water flow path in the head.

5. The apparatus of claim 4, wherein the lever is affixed to the elongated tubular member by a pivot connection and disposed on the side thereof facing in the direction of the pool cleaner movement.

6. The apparatus of claim 5, wherein the elongated tubular member is disposed at an angle with respect to a plane of the head portion to be in suction adherence to the submerged pool surface and oriented toward the direction of movement of the pool cleaner during operation, and wherein the lever is affixed to the underside of the elongated tubular member for pivotal movement in a plane substantially parallel to a vertical plane containing the centerline axis of the elongated member.

* * * * *

UNITED STATES PATENT AND TRADEMARK OFFICE

CERTIFICATE OF CORRECTION

PATENT NO. : 4,761,848

DATED : August 9, 1988

INVENTOR(S) : Helmut J. Hofmann

It is certified that error appears in the above-identified patent and that said Letters Patent is hereby corrected as shown below:

Column 1, line 28, "wate" should read -- water --.

Column 5, line 3, before "through" insert -- source --.

Column 5, lines 11 and 12, delete "an automatic submerged pool surface by suction applied to the outlet;".

Signed and Sealed this

Sixth Day of December, 1988

*Attest:*

DONALD J. QUIGG

*Attesting Officer*

*Commissioner of Patents and Trademarks*